United States Patent [19]

Kaiser

[11] Patent Number: 4,565,367

[45] Date of Patent: Jan. 21, 1986

[54] HAND HELD BODY ENGAGING EXERCISE DEVICE

[75] Inventor: Robert T. Kaiser, Elyria, Ohio

[73] Assignee: Spymark, Inc., Vista, Calif.

[21] Appl. No.: 515,306

[22] Filed: Jul. 19, 1983

Related U.S. Application Data

[63] Continuation-in-part of Ser. No. 267,270, May 26, 1981, abandoned.

[51] Int. Cl.[4] ..... A63B 21/00

[52] U.S. Cl. ..... 272/126; 272/142; 272/137

[58] Field of Search ..... 272/137, 136, 142, 126, 272/20 R, 93, 140; 273/200 R, 26 D

[56] References Cited

U.S. PATENT DOCUMENTS

| | | | |
|---|---|---|---|
| D. 178,837 | 9/1956 | Huszar | 124/20 R UX |
| 2,945,695 | 7/1960 | Heimers et al. | 273/200 R X |
| 2,951,702 | 9/1960 | Goodwin | 272/140 |
| 3,083,016 | 3/1963 | Sumegi | 272/142 X |
| 3,215,429 | 11/1965 | Shaboo et al. | 272/137 |
| 3,256,015 | 5/1966 | Perrin | 272/137 X |
| 3,312,466 | 4/1967 | Melchiona | 272/137 |
| 3,618,942 | 11/1971 | Bates | 272/136 |
| 3,703,294 | 11/1972 | Fitch | 272/142 X |
| 4,026,549 | 5/1977 | Gunn | 272/142 X |
| 4,257,591 | 3/1981 | Evans | 272/93 X |
| 4,328,964 | 5/1982 | Walls | 272/142 X |

*Primary Examiner*—Richard J. Apley
*Assistant Examiner*—Wiliam R. Browne
*Attorney, Agent, or Firm*—Calvin E. Thorpe; Vaughn W. North; M. Wayne Western

[57] ABSTRACT

An apparatus for simulating athletic running, throwing and swinging movements and for exercising and strengthening leg, arm, wrist, shoulder and back muscles used in such athletic movements. The apparatus is operated by the athlete and utilizes the athlete's body as a fulcrum to develop rotational motion such as arises in running, pitching, throwing and swinging motions. The exercise apparatus has an elongated rigid tubular member, with an attached hand grip at one end thereof. An exercise grip member is attached by an elastic cord to the opposing end of the tubular member and is used by the athlete to exercise the throwing/swinging arm or leg. Simulation of actual throwing and swinging motion, with greater freedom of movement on the part of the athlete during such exercises may be carried out with the device.

16 Claims, 21 Drawing Figures

HAND HELD BODY ENGAGING EXERCISE DEVICE

BACKGROUND OF THE INVENTION

1. Related Applications

This application is a continuation-in-part of my earlier filed application Ser. No. 267,270, filed May 26, 1981, now abandoned.

2. Field of the Invention

This invention relates to a device to be used for exercising and strengthening those parts of the body which are involved in a throwing, swinging, or running motion.

Specifically, the invention provides an exercise apparatus to be used by any person engaging in sports activity (referred to herein as an athlete) for exercising the arm, wrist, legs, shoulder and back muscles. Typically, these muscles are used in running or in the throwing of balls or swinging of rackets in sports activities, such as handball, football, baseball, racquet ball, tennis, golf and the like.

3. Prior Art

The use of the arm to throw, swing at or serve a ball is involved in almost all major sports in this country. Extensive use of the arm in this capacity has, in many cases, resulted in injury because forces applied to muscles by swinging or throwing exceed normal ranges of motion. In view of this fact, throwing and similar motions are not considered to be a building-up process, but instead, often constitute a tearing down process which results in the formation of muscle tears, forming scar tissue. The scar tissue is weak and has limited blood supply and destroys the throwing ability of the muscles involved because of limited muscle flexibility. It is evident that a proper exercise technique is needed to build up and strengthen running and throwing muscles and to provide a way to simulate in a controlled exercise environment the forces of actual competition without the jerking motion which normally accompanies throwing, swinging or running activities.

Up to the present time, however, no such exercise method or apparatus has been developed. In baseball, where there is considerable problem of loss of pitchers' throwing ability due to the appearance of "bad" arms, the teams have employed trainers who administer relief by applying salves or ointments to the muscles involved. Baths and massages are also employed to improve circulation at the injured area. These techniques, however, deal only with the existing problems of injury and do nothing to prevent the injury in the first instance.

Some physical exercises have been proposed in various texts, such as *Conditioning for Baseball* by Spackman, Jr. However, such exercises have only involved the conventional weight lifting or push-up exercises or two-man exercise teams, and no successful attempt has been made to utilize an apparatus which permits the operator himself to strengthen the throwing or running muscles and do it in a way which duplicates the forces found with actual running, throwing or swinging motion.

OBJECTS AND SUMMARY OF THE INVENTION

It is an object of the invention, therefore, to provide a new apparatus for exercising those parts of the body which are involved in running, throwing or swinging motion.

It is a further object to provide a new apparatus for exercising the arm, wrist, shoulder, back and leg muscles which permits duplication of the actual throwing, swinging or running motion.

It is a further object to provide an apparatus for exercising the arm, wrist, shoulder, back and leg muscles which permits use of counter-pressure stretch techniques to extend normal ranges of motion, build-up and strengthen those muscles.

It is a further object to provide a new exercise apparatus for the throwing muscles which can be operated by the person himself and can be positioned in a number of orientations and angles as needed to provide a pivot point so that leverage can be applied to create forces duplicating forces of throwing, swinging or running.

It is a further object to provide an apparatus which, when properly used, prevents serious injury to throwing, swinging or running muscles and thereby extends the sports life of the athlete involved.

These and other objects are realized in a hand-held exercise device which is adapted for individual use by an athlete in a controlled environment wherein all motions and exercises can be performed in a calculated and predetermined manner, without the pressures, unexpected movements and overexertions which typically occur in a competitive environment. The subject exercise device enables the athlete to simulate such rigorous muscular and anatomical movements which are unique to various physical sports activities without the aid or necessity of external exercising machines which are not under the immediate and constant control of the athlete.

The subject exercise device comprises an elongated, rigid, tubular member having a length of approximately 26 to 38 inches and a diameter which is generally no greater than one and one-half inches. The tubular member is structurally constructed to withstand a force of at least 50 pounds which may be applied from both axial and non-axial orientations with respect to the longitudinal axis thereof. The tubular member has operational parts comprised of a base end, a top end and an intermediate section therebetween. Gripping means are attached to the base end to enable the athlete to hold the tubular member in a firm, stable grip. An elastic cord is coupled to the top end of the tubular member and has elastic properties which permit at least 50% elongation of the cord beyond its unstretched length, which is generally no less than four inches.

An exercise grip member is attached to the other end of the cord and is adapted in size and configuration for being held at the hand or retained at the foot of the athlete during exercising. This exercise grip member may be a baseball, racquet handle, sling grip or other similar means for enabling the athlete to pull the top end of the tubular member in a desired orientation or exercise movement. This configuration enables the athlete to be in constant and full control of all forces applied to various parts of his body through the exercise device. This prevents injury which might occur by reason of an external machine which may cause the athlete to exceed his safe range of motion.

These and other objects will be apparent to those skilled in the art from the following detailed description, taken in combination with the accompanying drawings which are described as follows:

DETAILED DESCRIPTION OF THE INVENTION

Figure 1:
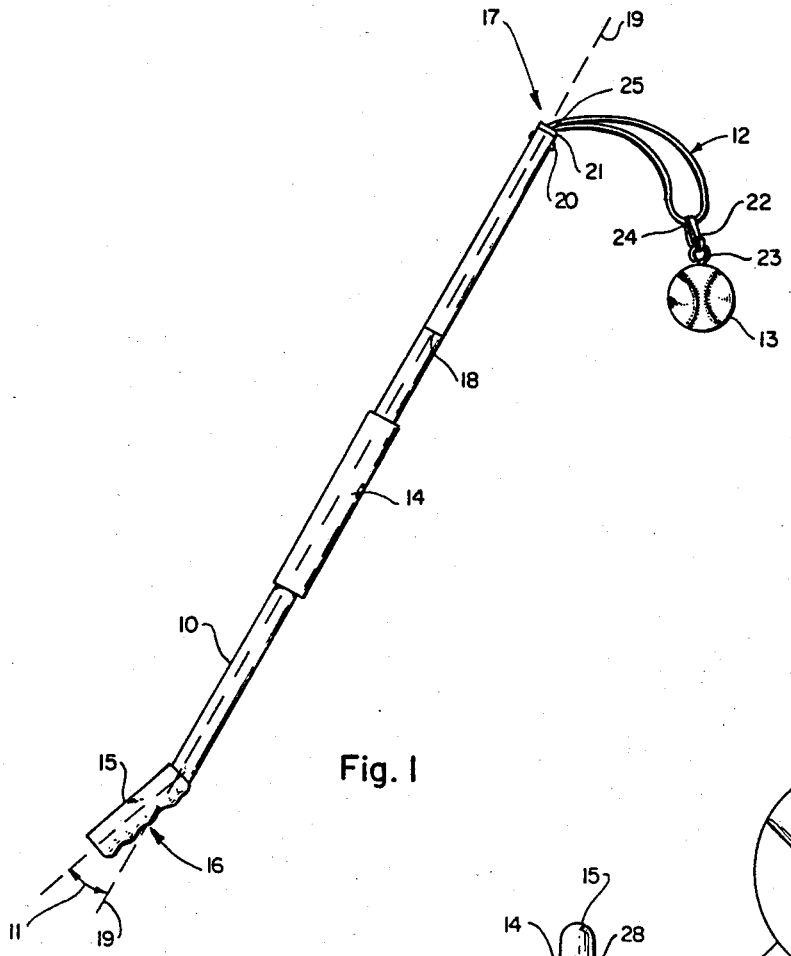
FIG. 1 is a perspective view of one embodiment of the subject exercise device, having a baseball exercise grip means attached to its elastic cord.

Referring now to the drawings:

FIG. 1 shows the preferred embodiment of a hand-held exercise device in accordance with the teachings of the present invention. This apparatus includes an elongated, rigid tubular member having a longitudinal axis 19, a base end 16, and a top end 17.

As shown in FIG. 1, the base end is positioned at an oblique angle 11 with respect to the longitudinal axis 19 of the tubular member. This bent portion of the tubular member provides an inclined handle for improving the grip orientation of the athlete during certain exercises. Typically, the angle 19 formed by the base end 16 with the longitudinal axis 19 is within the approximate range of 10 to 40 degrees. The specific angle 19 illustrated in FIG. 1 is approximately 25 degrees. The benefit of having a bent elbow at the base end of the tubular member will be appreciated by viewing the gripping orientation in the exercise illustrations contained herein.

The base end includes gripping means 15 attached to enable the athlete to hold the tubular member with a firm grip. This gripping means may be a rubber or plastic handle bar grip as illustrated in the figure, other types of gripping means which provide a comfortable, non-slipping surface to enable the athlete using the device to maintain firm control during exercising.

The tubular member has an approximate length between the range of 26 to 38 inches and a diameter no greater than approximately one and one-half inches, with a preferred outer diameter falling within the range of 0.078 inches to 1.000 inches where conventional-sized metallic pipe is used. The preferred length of the tubular member, as illustrated in FIG. 1, is 33 inches. This distance extends from the base part of the handle 15 to the top end 17. If the device is to be used by a young person, such as a little league baseball player, the preferred length would be approximately 28 inches.

As indicated above, the tubular member may be constructed of metal, typically aluminum or steel. Tubular wall thickness for aluminum construction will typically fall between 0.049 to 0.083 inches. Steel wall thickness would preferrably be within the range of 0.028 to 0.049 inches. Plastic materials may also be utilized, having a typical tube wall thickness of 0.050 to 0.100 inches. The material construction of configuration of the tubular member must be capable of withstanding a force of at least 50 pounds applied from both axial and non-axial orientations with respect to the longitudinal axis. More preferrably, the tubular member should be able to withstand forces of 100 pounds or greater.

Although variable lengths may be desirable for the tubular member, it is preferable to construct the subject device with a single length of tubular material to provide a sturdy, rigid, and stable exercise structure. In most cases, however, where adjustable lengths are desirable over the indicated stability, the tubular member 10 can be adapted to adjust to different lengths by use of telescoping structure 18, wherein the top end of the tubular member can be extended from within the lower portion of the tubular member, below the telescoping point 18.

The tubular member is further adapted with padding means 14 which circumscribes an intermediate section thereof to provide a cushion between the rigid tubular member and the athlete at a point of contact therebetween. The padding means illustrated in FIG. 1 comprises a tubular shaped, foam rubber pad having a length of approximately eight inches and an inner diameter slightly smaller than the outer diameter of the tubular member 10. The padding means should have sufficient thickness to provide comfort at the point of contact between the athlete and the rigid tube structure. This can be appreciated by viewing illustrations of the various exercises which can be accomplished with the subject invention, as shown in the figures. It will be apparent that other types of pads or cushions could be readily adapted to enhance comfort and protect against injury during exercising. It should be noted that the padding means would typically be positioned at a location of the tubular member which contacts the body and operates as a lever and fulcrum in performing certain exercises. It should therefore be capable of being repositioned along any part of the tubular member length.

The top end 17 of the tubular member is adapted for attachment of an elastic cord 12 at a first end 25 thereof. A second end 24 of the elastic cord includes clip means 22, which enables the athlete to attach an exercise grip member 13 by means of a clip retainer 23 which is firmly attached to the exercise grip member 13.

As used herein, the first 25 and second 24 ends of the elastic cord are figurative representations which define the relative proximity of the cord to the tubular member. The first end 25 is that part of the cord which is attached to the top end and therefore has the most proximate position to the tubular member. The second end 24 is that part of the elastic cord which is most remote from the tubular member and is adapted with means for attachment of the exercise grip member, which forms an integral part of the exercise device.

Figure 2:
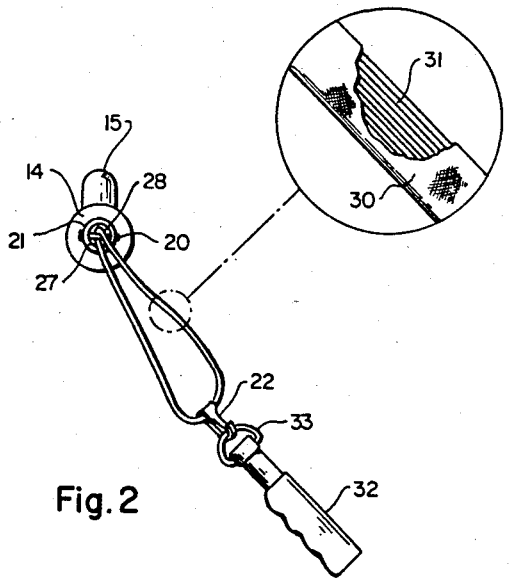
FIG. 2 is a top view of the device shown in FIG. 1, with a handle grip used as the exercise grip member, instead of a baseball.
Figure 3:
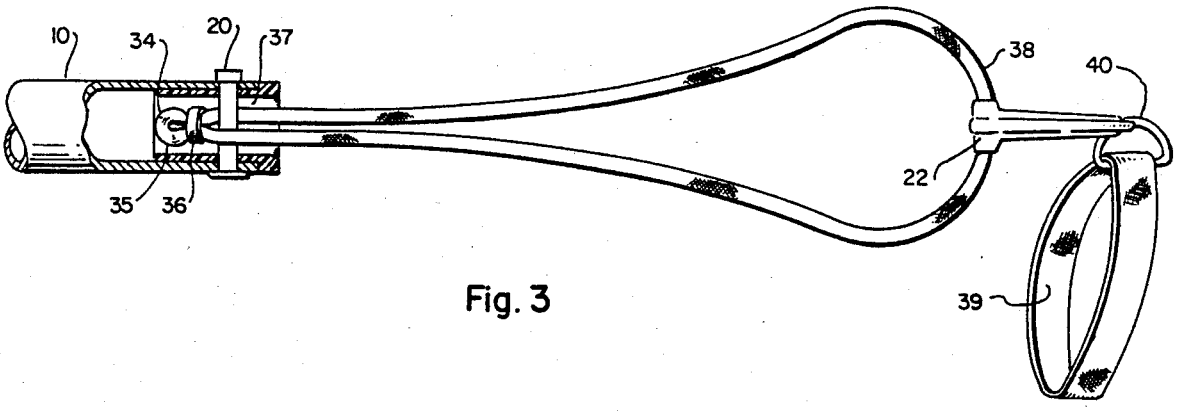
FIG. 3 provides a cut-away view of the end of the tubular member of the subject invention, with a sling grip used in place of the baseball or handle grip shown in FIGS. 1 and 2.

The first end 25 is coupled to the top end of the tubular member 17 by means of a retaining pin 20 which is positioned diametrically across the longitudinal axis 19 of the tubular member and at its top end. As shown in FIGS. 2 and 3, the cord is attached at the pin and is adapted to extend away from the base end of the tubular member, at least partially along the longitudinal axis. It will be apparent to one skilled in the art that many different methods of attaching the elastic cord 12 to the top end 17 of the tubular member can be utilized to accomplish the same objectives and establish the proper orientation of the elastic cord with respect thereto.

For example, the elastic cord should have an unstressed length of at least four inches, enabling the elastic cord to extend beyond the top end of the tubular member by a distance approximately within the range of four to nine inches. More preferrably, the cord length between the first and second ends is within the range of six to eight inches. These lengths are significant because they enable proper positioning of the tubular member and the exercise grip member with respect to the exercising athlete. As will be noted from the drawings which illustrate various exercise techniques, the proper orientation of the exercise grip member and tubular member are most significant.

The specific elastic cord configuration illustrated in FIG. 1 comprises a cord having a length at least twice that of the desired distance of the exercise grip member 13 from the top end 17 of the tubular member. This cord 12 has been looped to permanently join its two free ends 34 and 35 (FIG. 3) to form the first end 25 of the cord. These free ends 34 and 35 may be clipped permanently together by means of a hogged ring retainer 36, or any other comparable means. This looped portion 37 allows insertion of the retaining pin 20 (FIG. 3) to position the first end within the top end of the tubular member as shown in FIGS. 2 and 3.

Because of abrasive contact which occurs between that portion of the elastic cord 37 and the top end 17 of the tubular member, a tubular plastic cap 21 is provided to prevent damage to the cord 12. This tubular plastic cap 21 has approximately the same outside diameter as the tubular member 10 and is positioned in common axial alignment with the longitudinal axis 19 at the extreme top end of the tubular member. This cap 21 has a rounded edge at its most distal inner perimeter 27 (FIG. 2) to protect the cord from being cut by sharp edges of the metallic tubular member. It would be apparent to those skilled in the art that other methods can be adapted to protect the elastic cord from damage, in view of the variety of stress and movement which is applied to the elastic cord during exercising.

Such protection is necessary in view of the fact that the elastic cord 12 absorbs most of the dynamic stress applied to the exercise device. As will become more apparent hereafter, the primary benefit of the subject invention is the ability of the subject exercise device to respond elasticly in various rotational exercise patterns, wherein the elastic cord is elongated to both strengthen and protect muscles from over-exertion at extreme ranges of motion.

Therefore, the elastic cord 12 must have elastic properties which permit at least 50% elongation of the cord beyond its unstressed length. As used herein, unstressed length means the length of the elastic cord between its first and second ends when the cord is in a static condition, without application of any outside forces. For example, the elastic cord is shown in FIG. 1 in an unstressed state. More preferrably, the elongation characteristics of the elastic cord should be such that an extension of 60% to 150% of the unstressed length of the cord is possible during exercise activity.

The elastic cord used in the preferred embodiment of the subject invention comprises a bundle of elastic bands 31 (FIG. 2) which are enclosed within a woven fabric encasement 30. This encasement may be of nylon or comparable strong material which has a tensile strength capable of withstanding an elongation force greater than approximately 50 pounds. The unstressed diameter of this type of elastic cord would typically fall within the range of approximately 3/16th to 5/16th of an inch. The bundled configuration of elastic bands enclosed within the woven fabric encasement provides the benefit of greater safety, in view of independent elongation of each of the elastic bands, along with protection from the fabric encasement. Furthermore, this configuration provides a more consistent elastic response during repeated stressing or elongation of the elastic cord.

Figure 4:
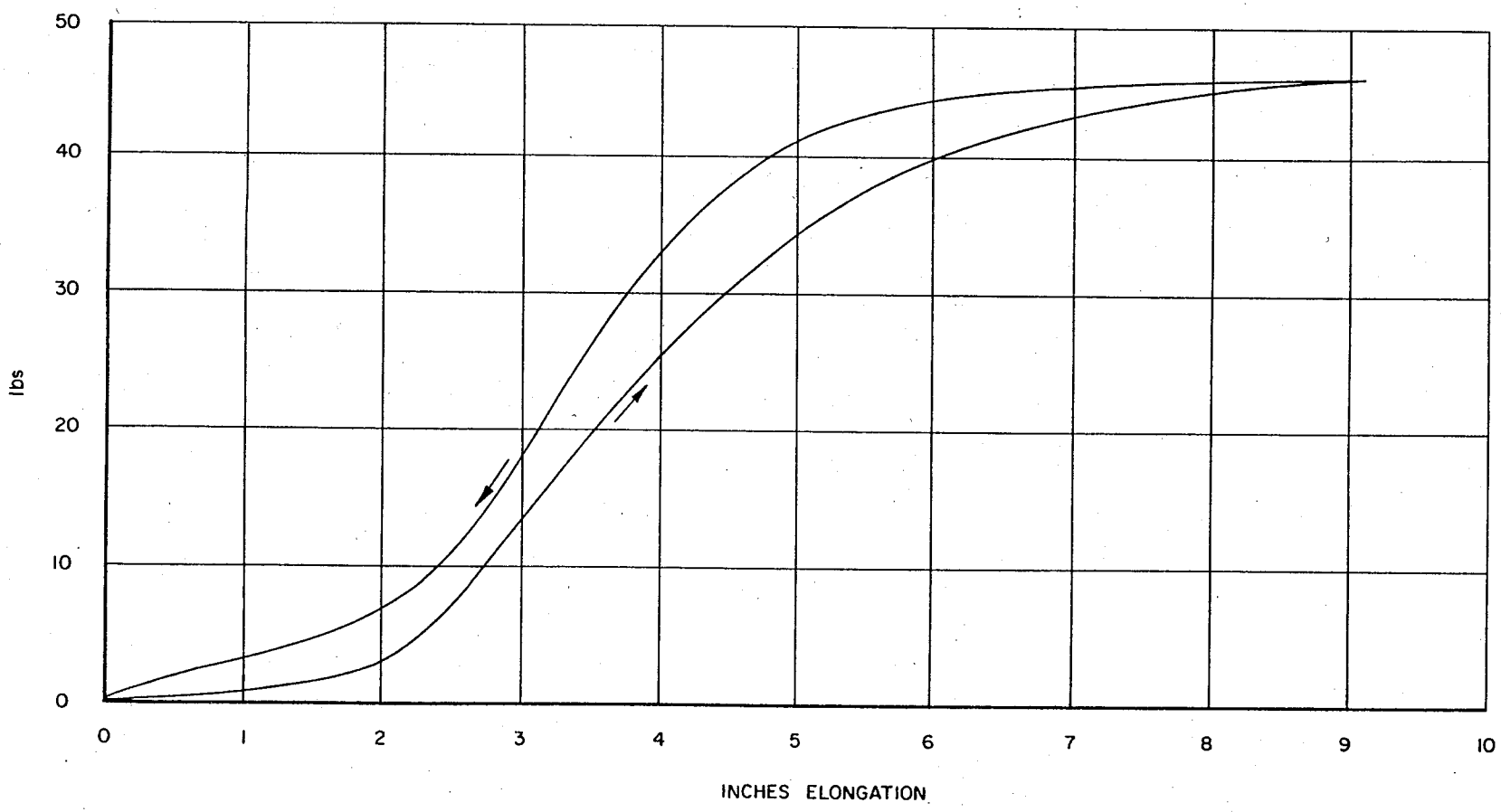
FIG. 4 is an elastomeric response curve showing tension in pounds versus elongation in inches for the elastic cord utilized in the present invention.

A typical elongation of the cord disclosed above is set forth in FIG. 4. This Figure discloses the degree of elongation (shown along the X axis) as the elastic cord is loaded with increasing and decreasing force over the range of 0 to 50 pounds (Y axis). Elastic properties represented by the elongation response shown in FIG. 4 is preferable for typical athlete use, especially where wrist, arm and shoulder muscles are of primary interest. Where exercises are primarily adapted for strengthening leg muscles in simulation of running sports, a cord having higher elastic modulus would be preferable.

The elastic cord 12 can be fabricated from suitable cord material, such as rubber strand and similar stretchable materials, which allow the desired elongation. The function of this elastic or flexible cord is to allow some flexibility during the exercise routine to the particular joints where articulation is taking place. This cord must be stretchable to provide a control cushion or margin of safety as the athlete exercises in extreme ranges of motion. In other words, when the athlete is stretched to the limit of his current muscular ability, the stretchable characteristic of the cord permits gentle flexation to further extend such range of motion without the occurrence of abrupt, jerking motion which can cause muscular strain. The stretchability characteristic of the elastic cord also acts as a pre-movement device to create counter-pressure to the articulated area of exercise. Therefore, it provides both stretching and strengthening benefits without undue stress to the muscles, particularly in the extreme range of movement.

It will be apparent to those skilled in the art that certain adjustments may be useful to optimize the subject invention for a particular athlete. Adjustments in cord length may be necessary to adapt the subject device to the particular stature of the athlete, and for particular exercise patterns. Elastic strength or stretchability may be adjusted to fit athletes, depending upon the degree of strength, experience, and exercise objectives applicable to each.

Finally, some adjustment of length may be useful to differentiate between types of exercises. For example, baseball exercises useful for practicing throwing motion may require a longer cord, as compared to swinging motions utilized with a racquet handle. Proper variation of the factors are well within the experience of those skilled in the art, based on the information disclosure contained herein.

As previously mentioned, the exercise grip member 13 is attached to the second end of the elastic cord 12 and comprises a primary element of the subject invention and related methods of exercise. Generally, the exercise grip member 13 is adapted in size and configuration for comfortable use at the hand or foot of the athlete. This grip member is utilized by the athlete to apply force to the exercise device to various parts of his body. Because of its attachment at the elastic cord 12, the amount of force is slightly attenuated where counter-force is applied through the tubular member 10 at a fulcrum point along its intermediate length, or by counterpressure at its base end 16.

Typically, the exercise grip member 13 comprises a hand-held member which conforms in size and configuration to an item of sports equipment. This item may be a baseball (as shown in FIG. 1) or a racquet handle 32 (FIG. 2), or any similar item of sports equipment which is customarily held in the hand of the athlete as part of a sports activity. It will be apparent to those skilled in the art that other exercise grip members may be applied to the subject invention, including a golf club shaft, a football, a javelin grip, or even a discus segment. Each of these various items of sports equipment develop unique muscular activity during exercising which can be simulated by use of the subject invention.

Where running and related activities requiring strength in the legs, ankles and knees are contemplated, a sling grip 39 (FIG. 3) can be attached to the elastic cord. This sling grip can be positioned around the foot, enabling exercises such as those illustrated in FIGS. 9 and 10. It is to be understood that other types of exercise grip members are contemplated, and that the subject disclosure is not to be considered exhaustive.

In view of the fact that a single athlete may desire to practice more than one of the exercise methods disclosed herein, the elastic cord 12 includes the previously disclosed clip 22 which allows quick attachment or removal of a variety of exercise grip members 13, 32 and 39. The clip means 22 is permanently attached to the elastic cord 12 and is adapted for removable coupling to a clip retainer 23, 33 or 40 which is securely anchored to the respective exercise grip members 13, 32 and 39. This combination of clip means and retainer enable the athlete to utilize the same tubular member and elastic cord for a variety of exercises which range through numerous simulated sports and running activities.

The methods for using the apparatus of the invention involve a variety of steps and motions depending on the muscles and types of development desired. As indicated previously, the primary purpose of this exercise device is to simulate running, throwing, or swinging motions which will be used by an athlete during sports activity. This particular device permits the athlete to experience the muscle tension and strain in his legs, hand, arm and body as it would actually develop during throwing the ball or swinging the racket or running. By using the exercise device, greater exertion can be applied to the throwing/swinging arm to thereby strengthen the muscles and related anatomical parts. The amount of exertion required is developed by counter-pressure applied, as illustrated by the following exercise steps.

To simulate swinging or throwing motions, the athlete first grasps the elongated tubular exercise device with the non-throwing/swinging hand. The location of this grip will depend upon the nature of exercise and the type of sports grip member being used. For example, the figures illustrate several grasps being applied at the gripping means (Figure sequences 5, 6 and 8) and at the midsection, as illustrated in Figure sequence 7. In simulating the swing of a racket (FIG. 8), the non-swinging hand would grasp the base end of the tubular member to apply a counter-force to the exercise grip member 32.

Figure 5:
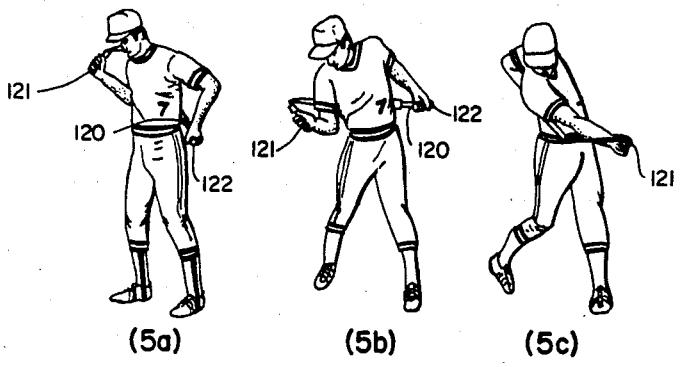
FIGS. 5*a*, 5*b*, and 5*c* illustrate the use of the subject invention as part of a baseball training exercise for hitting.
Figure 6:
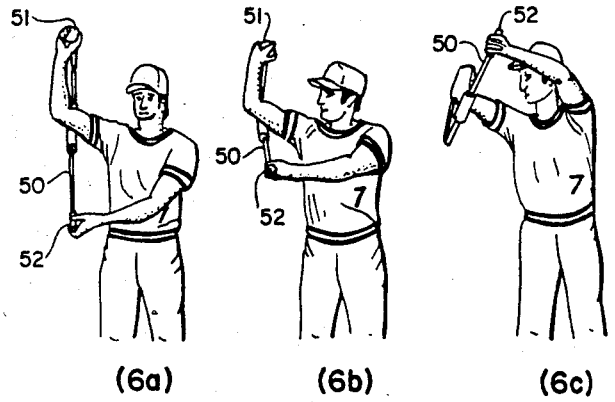
FIGS. 6*a*, 6*b*, and 6*c* illustrate an additional baseball exercise for throwing.
Figure 7:
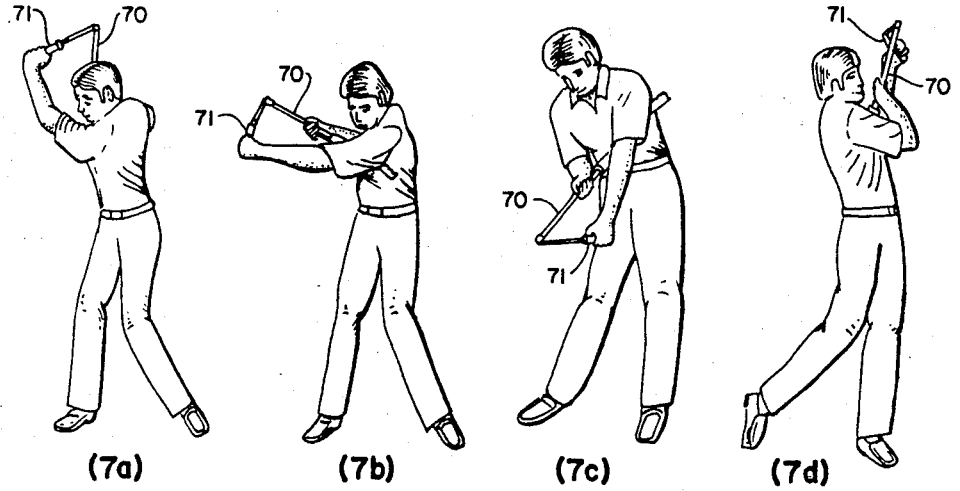
FIGS. 7*a*, 7*b*, 7*c*, and 7*d* illustrate the use of the subject device in connection with a golfing exercise simulating the swinging of a golf club.
Figure 8:
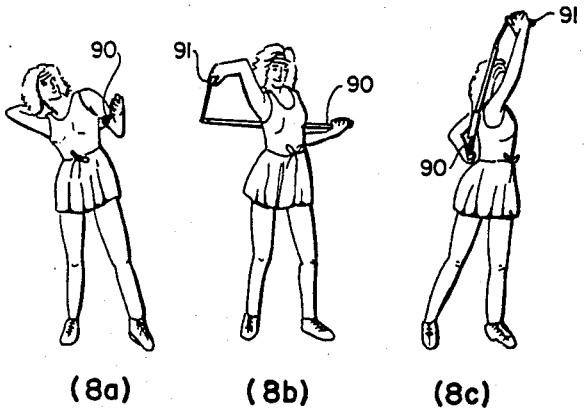
FIGS. 8*a*, 8*b*, and 8*c* illustrate the use of the subject device to simulate tennis serving motion.

The figures illustrate how this tubular member can be applied to various parts of the body at either the tubular midsection or remote end to develop the desired rotational exercise. The relative orientation at which the tubular member is grasped with respect to the exercise grip member obviously depends on the location of the tubular member against the body to develop the desired fulcrum relationship. FIGS. 5, 6 and 8 illustrate the fulcrum position of the body at a midsection of the tubular member. This orientation provides a reduced radius of rotation for the exercise, such as is typified in throwing a ball in overhand fashion. FIG. 7 illustrates a second fulcrum position, in which the remote end from the sports grip member operates as the axis of rotation for the tubular member. This is useful in exercises requiring a larger radius of movement such as developed in swinging a golf club. Numerous relative orientations of gripping the subject apparatus can be developed; however, in each instance, it will be noted that relative movement of the throwing/swinging and non-throwing/swinging arms is in opposing direction.

Typically, exercises conducted with the subject apparatus will involve a subsequent step of orienting the throwing/swinging hand to an initial throwing/swinging position. This is typically the position which an athlete takes prior to initiating a pitch, service or forehand swing with a racket.

Next, the athlete develops tension in the cord means by moving the non-throwing/swinging hand and tubular member in counter-rotation to the direction of the projected exercise. As the tension is applied to the cord means, the throwing/swinging hand is required to exert a counter-force in the direction of projected exercise. This builds strength without a chance of being overpowered by extreme weights, etc.

Finally, the actual throwing or swinging movement is simulated by moving the throwing/swinging arm in the direction desired, while at the same time applying a continuous counter-force with the non-throwing/swinging arm. The intensity of this counter-force can be varied to develop forward and rearward motion, as well as increased exertion by the throwing arm.

Where the exercise grip member is a baseball device, a typical pitching movement can be simulated by the athlete by positioning the tubular member 50 at a back side of the throwing arm as illustrated in FIG. 6, the throwing hand having a firm grasp on the baseball device 51 and the non-throwing hand being positioned below the throwing arm with a tight grasp on the base end 52 of the tubular member. The exercise is developed by moving the throwing arm in a simulated pitch motion or in positions associated with throwing, while at the same time applying a counter-force with the non-throwing arm. The forward motion of the throwing arm is developed by reducing the intensity of the counter-force to less than the pitching force being applied.

The use of a flexible cord between the baseball device and tubular member provides a cushioned resistance to sudden movements, or excessive movements of counter-pressure. In other words, as the counter-force is applied and brings the throwing arm rearward to a limiting position, the tension in the cord increases without further movement of the throwing arm. This feature can be utilized to stretch the muscles to a greater extent by applying continued force with the non-throwing arm when the throwing arm is in its limiting rearward position. The tension applied to the muscles is thereby varied, permitting the desired stretching response.

Figure 11:
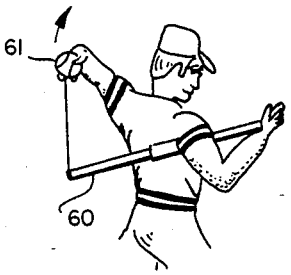
FIG. 11 illustrates an additional throwing exercise.

This type of exercise is illustrated in FIG. 11, in which the tubular member 60 is grasped at one end by the non-throwing arm, the midsection of the tubular member being seated under the non-throwing arm and against its associated clavicle. The athlete then grips the exercise grip member 61 by the throwing hand and brings tension against the tubular member by pulling on the grip member and lifting on the other end of the tubular member with the non-throwing hand. With this tension applied, the athlete slowly rotates the tubular member about the shoulder, varying the applied force to stretch the muscles of the throwing arm toward a rearward initial pitch position.

Figure 12:
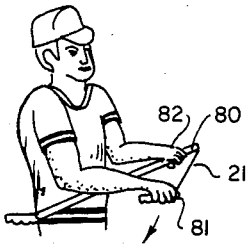
FIG. 12 shows an additional exercise simulating swinging motion.

As illustrated in FIG. 12, this general exercise method can be applied to the use of sports equipment in which a swinging motion is applied to a handled device such as a tennis racket, racketball racket, golf club, etc. In this case, the exercise grip member comprises a racket handle 81 which is attached by a cord 83 to the tubular member 80. The athlete grasps the tubular member 80 toward the racket handle 81 by the non-swinging hand 82. The swinging hand grasps the racket handle and the lower part of the tubular member is brought against the waist portion of the athlete's body, which operates as the fulcrum point. The exercise is conducted by pulling forward on the racket handle with the swinging arm while at the same time pulling rearward on the tubular member with the non-swinging arm. The intensity of rearward pulling motion may be varied to permit forward and rearward pivotal movement of the tubular member along a path which would be followed by the athlete in actual swinging motion.

Here again, the utility of the subject apparatus, with its synergistic effect, is noted. The athlete is totally free to move and swing with his body to develop a realistic swinging motion as applied in actual sports play. At the same time, the athlete is able to apply variable force to strengthen the muscle tone, to stretch the muscles and ligaments and to develop a general strengthened ability toward that specific movement.

A second, common form of swinging motion occurs in the sport of golf. The present invention is effective in improving many technical aspects of athletic ability in this sport, as well as strengthening and coordinating muscular development. FIGS. *7a, 7b, 7c,* and *7d* illustrate one method of exercise and training particularly adapted for improving the golf swing. It works on the entire motion from the top of the backswing to the moment of impact.

As shown in FIG. *7a,* the athlete grasps the exercise grip member 71, which is a handle similar to that used in the previous tennis exercise, with his swinging hand. With his other hand, he grasps the midsection of the tubular member 70. The base end of the device is positioned against the chest and under the swinging arm as illustrated in FIG. *7b,* and the top end of the device is rotated upward as shown in FIG. *7a.*

With the starting position, the athlete can increase the range of motion by gently pulling rearward with the non-swinging arm. In response to this action, the elastic cord 72 will elongate and will enable the gradual extension of shoulder rotation. This trains the muscles to initiate the swing at the furthest point from impact for greater club head speed.

The next step, shown by FIG. *7b,* is accomplished by relaxing and bringing the arms quickly and smoothly toward the impact position, represented by FIG. *7c.* At this impact position, the athlete applies forward force with his swinging arm, while resisting such motion with his non-swinging arm. This strains the shoulder and forearm muscles to swing with greater force, while maintaining better control of the club at impact.

This exercise method can likewise be applied to swinging motions similar to batting in baseball and related sports. As illustrated in FIG. *5a,* the athlete assumes a batting stance and grasps the base end 122 of the device with his non-swinging hand. With his swinging hand, he grasps the handle grip member 122, using an orientation similar to that used to hold a bat. The tubular member 120 is then positioned against the back of the athlete for leverage.

The exercise proceeds by pulling the grip member 121 in accordance with proper batting motion. At the same time, resistance is applied by the non-swinging hand at the base end 122. Trunk rotation and follow-through are coordinated with this action to enhance coordination and to strengthen shoulder, forearm, hand and wrist muscles.

FIG. 8 represents an exercise method applicable to serving motions such as might be used in tennis, racquet ball, and badminton. The tubular member 90 is positioned under the shoulder of the non-swinging arm in a rearward direction. The handle grip member 91 is grasped by the swinging arm, and the base end of the device is gradually raised, thereby lowering the top end. This gently pulls the serving arm back into its extreme starting position, to train for maximum service power. The maximum rotational range of the athlete can be extended by gently rocking the tubular member up and down to increase flexibility of the shoulder rotators.

The exercise is completed by pulling the device forward with the serving hand, while resisting with the non-serving hand. The present invention enables the athlete to gradually increase the resistance based on his own sense of full control of counter-forces. By increasing the force of the non-serving hand, the service motion can be retraced to increase coordination and accuracy.

Figure 9:
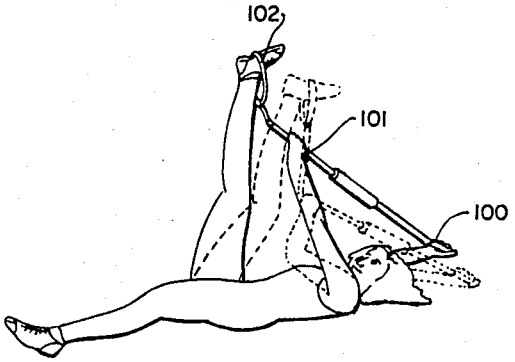
FIGS. 9 and 10 illustrate movements using the subject device to improve flexibility for running.
Figure 10:
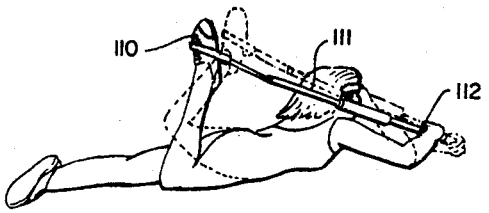

FIGS. 9 and 10 illustrate applications of the present invention for running simulation. As shown in FIG. 9, an effective leg stretching technique can be practiced by using the sling grip 102, positioned on the athlete's foot. The base end 100 is grasped by one hand and the top end 101 is gripped in the other. The athlete then pulls the top end toward the chest, causing the elastic cord to elongate and gently stretch leg muscles. The range of movement can be gradually increased by bouncing the top end of the tubular member up and down to improve flexibility in this extreme position. This exercise increases forward range of motion for the legs.

FIG. 10 illustrates a knee bend and stretch exercise using the subject invention. With the sling grip positioned on the foot as shown, the athlete grips the base end with both hands and gently pulls forward. Upon reaching maximum forward extension, the foot is pulled slightly forward in repeated manner to increase the range of motion. The exercise is completed by extending the leg rearward and forward as part of an isotonic exercise pattern.

In considering the specific exercise method to be used, the muscle movement should be evaluated. Muscular activity that results in movement or work involves two sets of muscles that act in varying degrees in opposition to each other, normally agonists and antagonists groups, as opposed to single muscles. At the initial phase of movement, rather little movement occurs because the initial force is spent in pulling against the joint. This initial phase is isometric. Further contraction initiates movement or isotonic contraction. These are the basics in which all muscular movement takes place, and it is the function of the new apparatus to effect such muscular movement and offer variable resistance to the initiatory movement as well as the movement of the domain.

To strengthen the arm, shoulder, pectoralis and back, the apparatus is placed as shown in FIG. 5. The ball is held in the throwing arm's hand. The apparatus is allowed to fall across the back with the protective pad being against the non-throwing arm's clavicle. Reach back with the non-throwing arm's hand and grasp the base end of the apparatus. Stretch the throwing arm and shoulder back as far as possible by applying pressure forward on the base end with the non-throwing arm. Using counter-pressure, exert a force in both directions for 10 seconds, then allow slow forward arm, shoulder and back rotation to complete the exercise.

Although a variety of exercises have been illustrated, additional exercises will occur to the operators as they develop experience in the above-noted examples. It should therefore be understood that the apparatus and process of the present invention can be embodied in other specific forms without departing from the spirit or essential characteristics of the invention. The present embodiment is, therefore, to be considered in all respects as illustrative and not restrictive, the scope of the invention being indicated by the appended claims rather than by the foregoing description, and all changes coming within the meaning and range of equivalency of the claims are therefore to be embraced therein.

I claim:

1. A hand-held exercise device adapted for individual use in a controlled environment and which enables an athlete to stimulate rigorous muscular and anatomical movements unique to various physical sports activities without the aid of external exercise machines, said device comprising:

an elongated, rigid, tubular member having a longitudinal axis, a length of at least 26 inches and a diamater no greater than approximately one and one-half inches, gripping means attached to one end of said tubular member for applying force to said tubular member during an exercise, an exercise grip means tethered to the opposite end of said tubular member so as to enable the tubular member to operate as a lever pivoting against the body of the individual when forces are applied to the ends of said tubular member;

an elastic cord having first and second ends, and an unstressed length of at least four inches, said first end being coupled to said opposite end of the tubular member and having elastic properties which permit at least 50% elongation of the cord beyond its unstressed length during exercising; and said exercise grip means being attached to the second end of the cord and adapted in size and configuration for comfortable use at the hand or foot of the athlete for application of force by the athlete through the exercise device to various parts of the athlete's body.

2. A device as defined in claim 1, wherein the tubular member is constructed of metal, with the grip means end positioned at an oblique angle with respect to the longitudinal axis of the tubular member, thereby providing an inclined handle for improved gripping by the athlete.

3. A device as defined in claim 2, wherein the angle formed by the grip means end with respect to the longitudinal axis is within the approximate range of 10 to 40 degrees.

4. A device as defined in claim 1, wherein the tubular member has an outer diameter within the range of 0.078 inches to 1.000 inches and a length of approximately 33 inches.

5. A device as defined in claim 4, wherein the tubular member is constructed of metal, with its grip means end positioned at an oblique angle of approximately 25 degrees with respect to the longitudinal axis of the tubular member, thereby providing an inclined handle for improved gripping by the athlete.

6. A device as defined in claim 1, wherein the elastic cord extends beyond the top end of the tubular member by a distance approximately within the range of 4 to 9 inches, said elastic properties enabling the cord to be elongated during exercising to an additional distance of approximately 60 to 150% of the unstressed cord length.

7. A device as defined in claim 6, wherein the elastic cord is formed by a bundle of elastic bands enclosed within a woven fabric encasement, said encasement having a tensile strength capable of withstanding an elongation force greater than approximately 50 pounds, the encased bundle having an unstressed diameter of approximately 3/16 to 5/16 inches.

8. A device as defined in claim 1, wherein the first end of the elastic cord is coupled to the tubular member by means of a retaining pin which is positioned diametrically across the longitudinal axis of the tubular member and at said opposite end, said cord being attached at the pin and being adapted to extend away from the opposite end, at least partially along the longitudinal axis of the tubular member.

9. A device as defined in claim 8, wherein the opposite end of the tubular member further comprises a tubular plastic cap having approximately the same outside diameter as the tubular member and which is positioned in common axial alignment with the longitudinal axis and at the opposite end of the tubular member, said cap having a rounded edge at its distal inner perimeter to thereby protect the cord from being cut during abrasive contact during exercising, said cap being partially mounted within the opposite end of the tubular member.

10. A device as defined in claim 8, wherein the elastic cord comprises a cord having a length at least twice that of the desired distance of the exercise grip means from the opposite end of the tubular member, the cord being looped to permanently join its two free ends to form said first end, said retaining pin being inserted within the loop to position the first end within the opposite end of the tubular member, said second end being formed by the looped end most remote from the first end and including means coupled thereto for attachment of the exercise grip means.

11. A device as defined in claim 1, wherein the exercise grip means comprises a hand-held member which conforms in size and configuration to an item of sports equipment which is customarily held in the hand of the athlete as part of a sports activity.

12. A device as defined in claim 11, wherein the configuration of the exercise grip means comprises the hand-held gripping portion of sports equipment.

13. A device as defined in claim 1, wherein the exercise grip means comprises a sling grip adapted for placement around the foot of the athlete.

14. A device as defined in claim 1, further comprising clip means coupled to the second end of the elastic cord and a clip retainer attached to the exercise grip means, the combination of clip means and retainer adapting the device for quick attachment or removal of a variety of exercise grip means.

15. A device as defined in claim 1, further comprising padding means attached to the tubular member along an intermediate section thereof and having sufficient thickness to provide a cushion between the rigid tubular member and the athlete at a point of contact therebetween.

16. A device as defined in claim 1, further comprising telescoping means coupled toward the opposite end of the tubular member to enable adjustable extension of the tubular member to a variety of lengths.

* * * * *